US005625942A

United States Patent [19]

Casey

[11] Patent Number: 5,625,942

[45] Date of Patent: May 6, 1997

[54] PRECISION CRIMPING TOOL

[75] Inventor: Daniel T. Casey, Harrisburg, Pa.

[73] Assignee: The Whitaker Corporation, Wilmington, Del.

[21] Appl. No.: 488,922

[22] Filed: Jun. 9, 1995

[51] Int. Cl.[6] ..... H01R 43/042

[52] U.S. Cl. ..... 29/751; 29/753; 29/760; 29/863; 72/409.14

[58] Field of Search ..... 29/33 M, 268, 29/750, 751, 753, 760, 863; 7/107; 72/410, 413, 409.14; 269/903

[56] References Cited

U.S. PATENT DOCUMENTS

| | | | |
|---|---|---|---|
| 3,800,584 | 4/1974 | Edwards, Sr. et al. | 29/751 X |
| 4,454,657 | 6/1984 | Yasumi | 29/751 X |
| 4,534,107 | 8/1985 | Maack | 29/753 X |
| 4,700,592 | 10/1987 | Rommel | 81/355 |
| 4,774,762 | 10/1988 | Gobeil | 29/861 |
| 4,828,516 | 5/1989 | Shaffer | 439/877 |
| 4,974,314 | 12/1990 | Nickerson et al. | 72/410 X |
| 4,979,291 | 12/1990 | Phillips et al. | 29/863 |

FOREIGN PATENT DOCUMENTS

| | | | |
|---|---|---|---|
| 261441 | 5/1964 | Australia | 29/751 |
| 0471977 | 2/1992 | European Pat. Off. | 29/751 |
| 6176842 | 6/1994 | Japan | 29/863 |
| 8301347 | 4/1983 | WIPO | 29/863 |

OTHER PUBLICATIONS

*AMP Instruction Sheet IS 7516* "AMP Screw Machine Contacts And Application Tooling", Released Dec. 3, 1990; pp. 1, 12, 12; AMP Incorporated, Harrisburg, PA.

*AMP Drawing,* Crimping Head Assembly, Part No. 125848–1; one sheet; AMP Incorporated, Harrisburg, PA.

*Primary Examiner*—Peter Vo

[57] ABSTRACT

A crimping apparatus (50) is disclosed for operation with either a manually operated or powered hand tool (30) or with an applicator in a press. The crimping apparatus (50) includes a crimper (52) and opposing anvil (54), each having a shank (100, 120) with a T-shaped openings (106, 126) therein. A self centering body (60) has one end (68) arranged to slide in one of the T-shaped openings (106) and the other end (70) arranged to slide in the other T-shaped opening (126) so that the crimper (52) and anvil (54) are free to move, with respect to the self centering body (60), toward each other and away from each other. The crimper is secured to a fixed plate (40) in the tool while the anvil is secured to a reciprocable ram (38). A pair of terminal supports (56, 58) are arranged in sliding engagement with two more T-shaped openings (108, 128), one in the crimper and one in the anvil. Each terminal support (56, 58) has a semicirular opening (146) in its end that engages the outer edge of the terminal barrel to hold it in centered position during crimping and to prevent deformation of the edge.

19 Claims, 9 Drawing Sheets

PRECISION CRIMPING TOOL

The present invention relates to tools for precision crimping terminals to the ends of conductors and more particularly to such tools having a self centering terminal holder.

BACKGROUND OF THE INVENTION

Tools that precision crimp terminals onto an electrical conductor typically utilize a crimping die assembly employing cam actuated indentors that perform the crimp. Such cam actuated devices are utilized where a precision crimp is required because such devices are strong and consistently provide an accurate crimp. A typical crimping die assembly is shown in FIGS. 1 and 2. There, a die holder 2 is shown having four equally spaced die ways 4 formed therein, each of which contains an indentor 6 having a crimping die 8 on its end extending into a crimping station 10, as best seen in FIG. 2. An actuating ring 12 is arranged around the die holder and includes camming surfaces that engage the outside ends of the indentors 6. When the ring is rotated with respect to the die holder, the indentors are cammed inwardly so that the crimping dies 8 converge in the crimping station 10. A terminal holder 14 having a bore 16 sized to receive and accurately position the terminal is held within a counterbored hole in the die holder 2. The crimping dies are arranged in the die ways of the die holder so that they converge onto the crimping station that is in the center of the terminal receiving hole in the holder. The actuating ring encircles the holder and the crimping station and, when rotated, will cause the crimping dies to mutually converge to crimp the terminal in the crimping station. Such a crimping die assembly is used in a hand operated crimping tool part number 601966-1distributed by AMP Incorporated of Harrisburg PA and is illustrated in their publication IS7516. It will be appreciated by those skilled in the art that in order to consistently produce accurate high quality crimps, this mechanism must be held to very high tolerances. This, coupled with the inherent complexity of the mechanism, results in relatively high manufacturing costs for the tool.

What is needed is a terminal crimping mechanism that provides for self centering of the terminal during the crimping cycle so that the close tolerances normally associated with such a precision crimping tool are relaxed. Further, it would be economically desirable to utilize a standard linear motion actuator to effect the crimp, instead of the more costly and complex rotary camming device described above.

SUMMARY OF THE INVENTION

A tool is disclosed for crimping a terminal onto a conductor. The tool includes an actuator mechanism having first and second mutually opposed members that are arranged to move in a first direction toward each other and in a second direction opposite the first direction. A crimper is coupled to and carried by the first member and an anvil is coupled to and carried by the second member. The crimper and anvil are arranged to matingly engage when the first and second members are moved in the first direction, thereby crimping the terminal onto the conductor. A body for receiving and holding the terminal is coupled to both the crimper and the anvil. The body holds the terminal so that its axis is perpendicular to the first direction during the movement of the first and second members in the first direction. The body is free to move laterally, with respect to the axis of the terminal, so that the terminal is automatically self centered between the crimper and the anvil when the crimper and anvil engage the terminal preparatory to crimping.

DESCRIPTION OF THE PREFERRED EMBODIMENT

Figure 2:
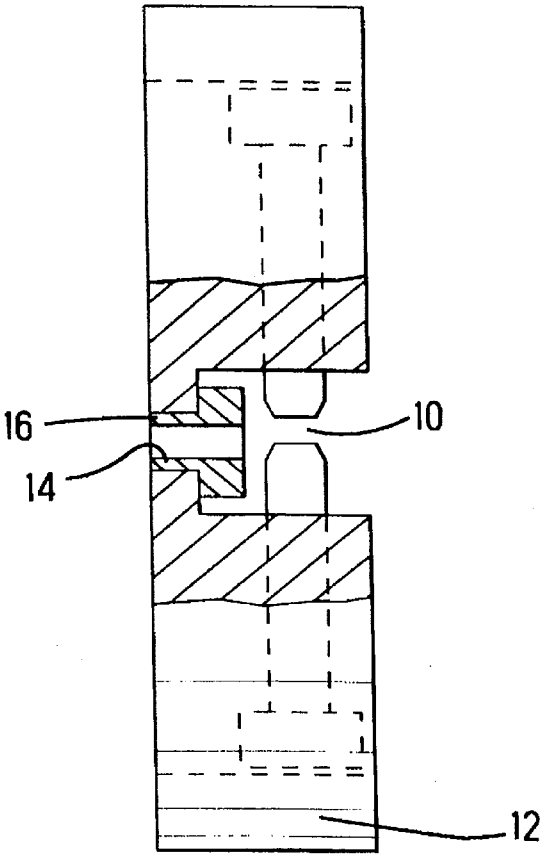
FIG. 2 Prior Art
FIGS. 1 and 2 are plan and side views, respectively, of a prior art crimping mechanism.
Figure 1:
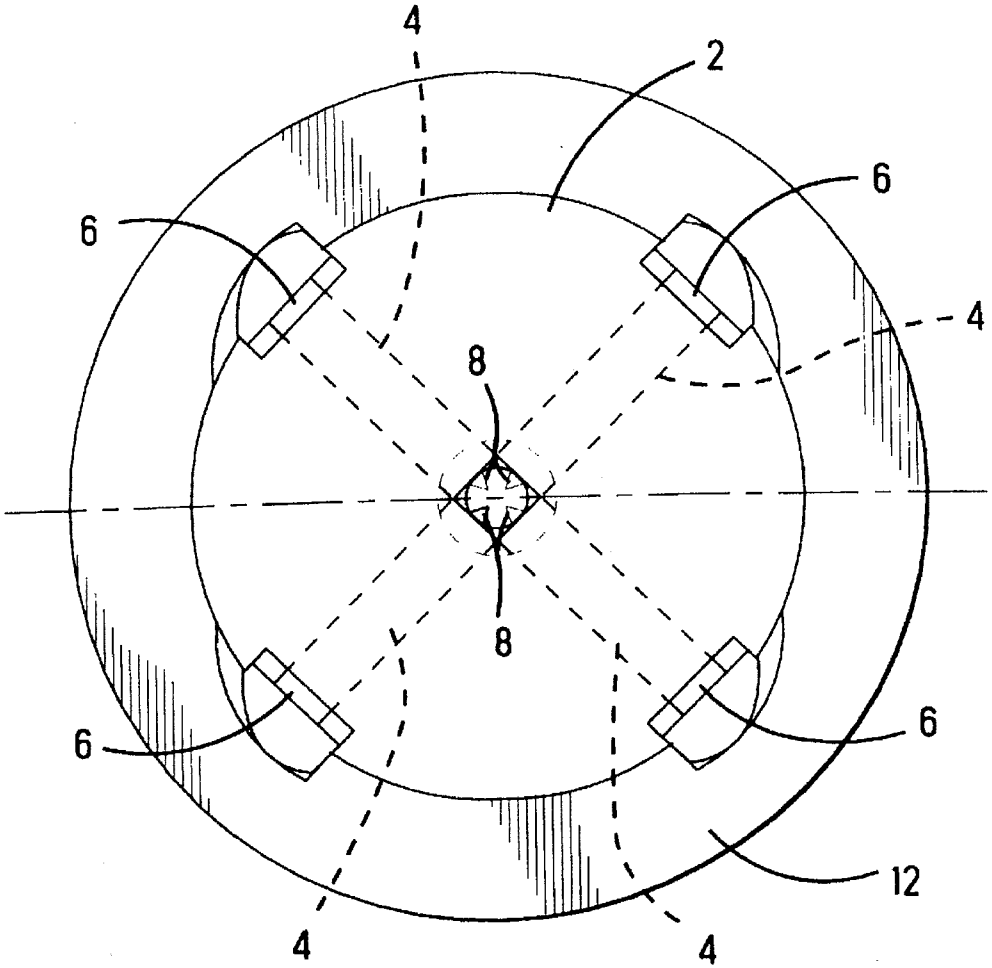
FIG. 1 Prior Art
Figure 3:
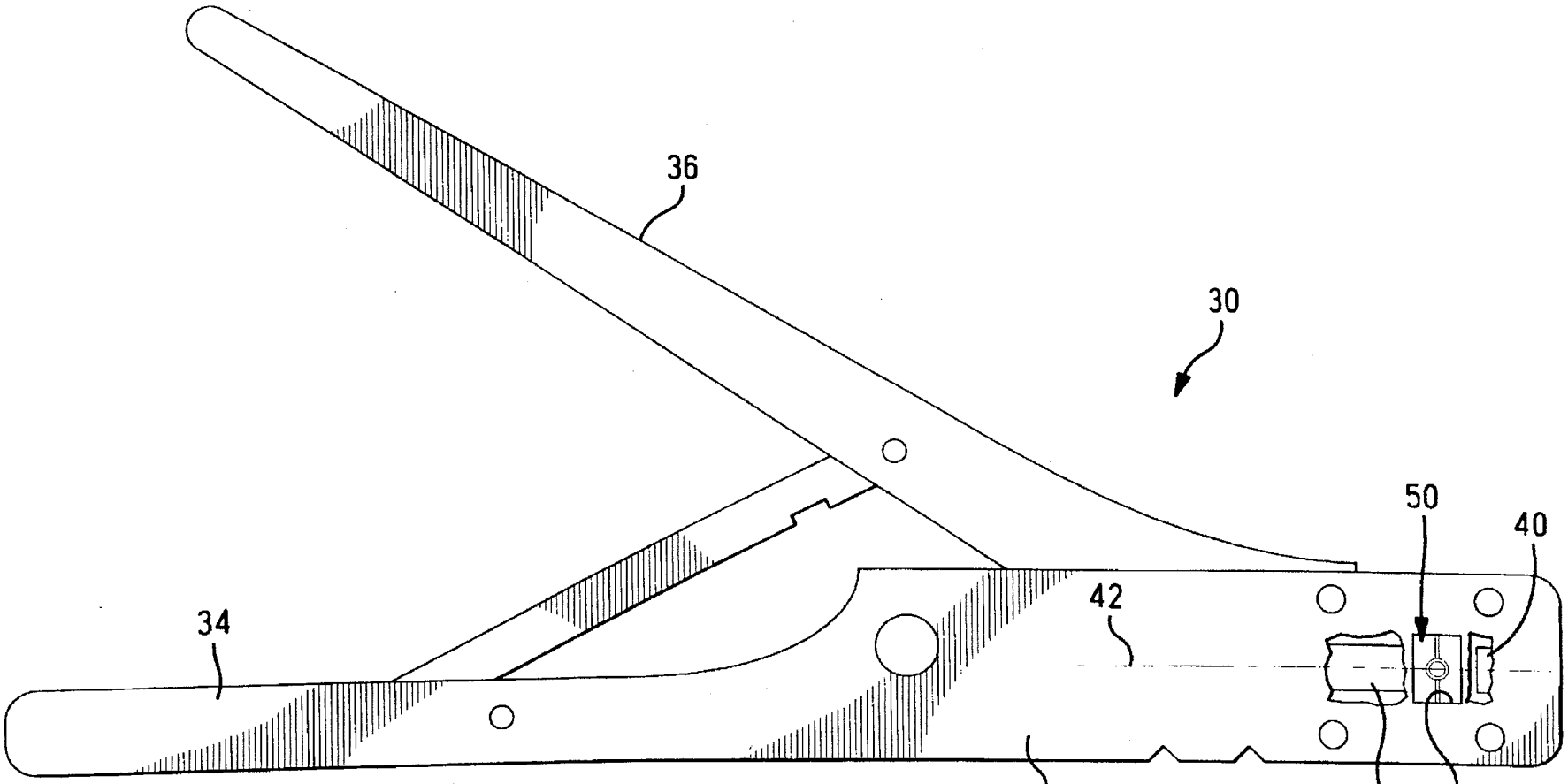
FIG. 3 is a plan view of a hand crimping tool incorporating the teachings of the present invention.

There is shown in FIG. 3 a hand tool 30 having a frame 32, a handle 34 extending from the frame, and an actuating lever 36. The actuating lever is coupled to a ram 38 for moving the ram along a ram axis 42 toward and away from a fixed plate 40 that is attached to the frame. A window 44 is disposed in the frame 32 between the end of the ram and the plate 40 for access to crimping tooling 50 contained within the frame.

Figure 5:
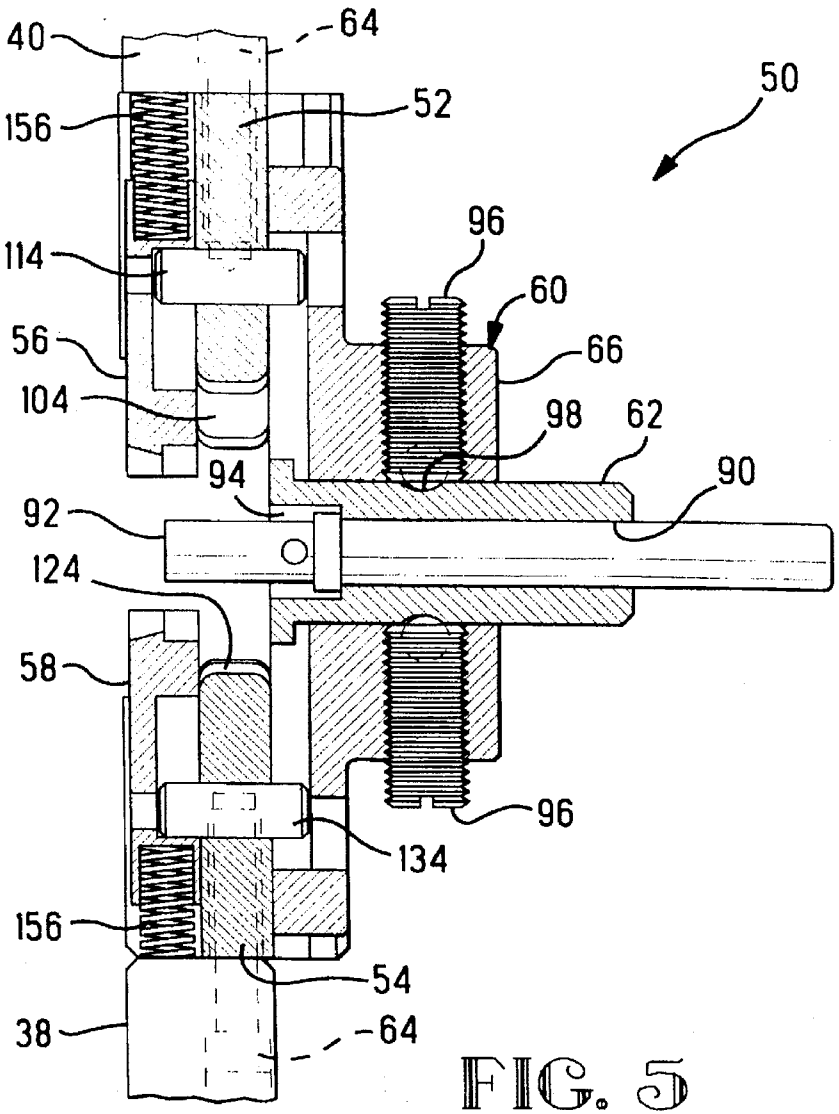
FIG. 5 is a cross-sectional view taken along the lines 5—5 in FIG. 4.
Figure 4:
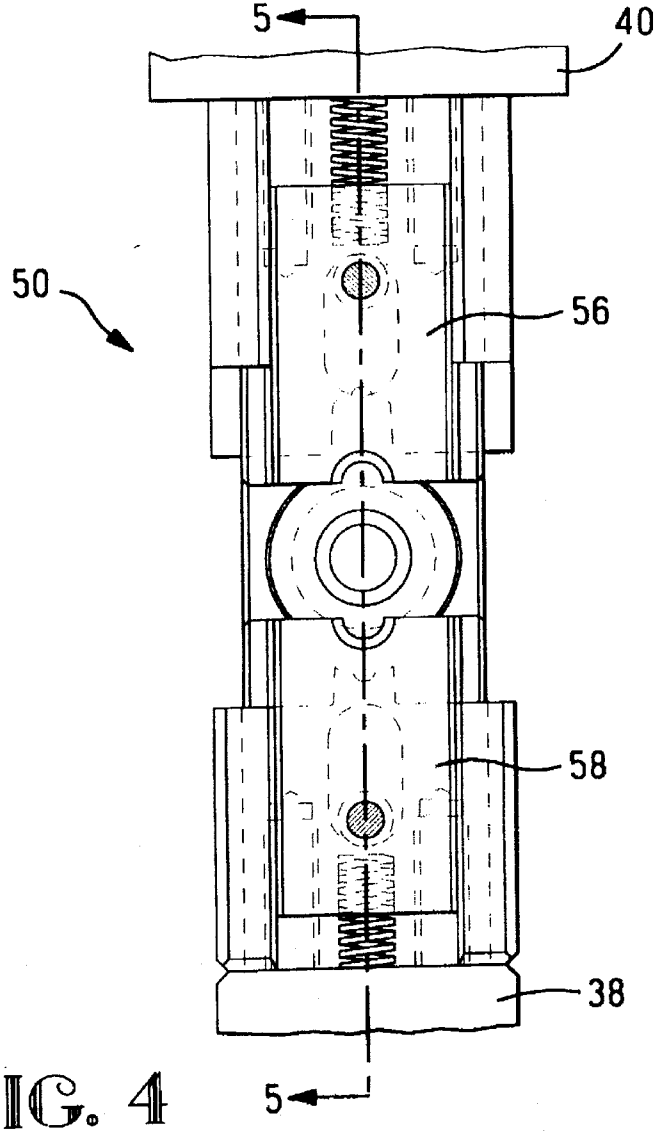
FIG. 4 is a front view of the crimping mechanism shown in FIG. 3.
Figure 8:
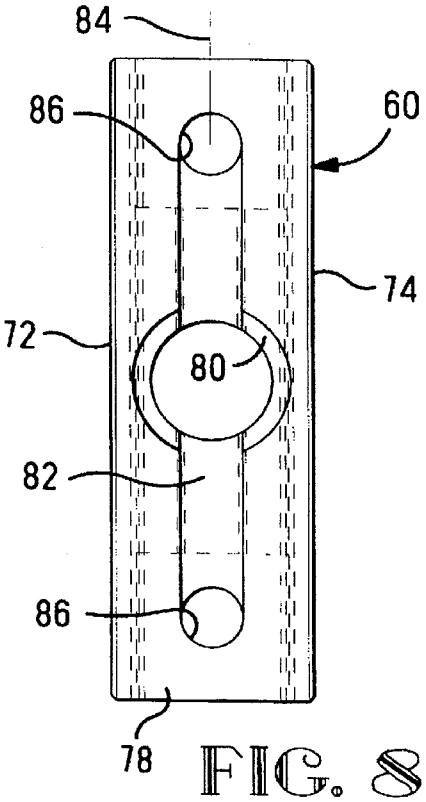
FIGS. 6, 7, 8, and 9 are front, side, rear, and end views, respectively, of the self centering terminal holder shown in FIG. 5.
Figure 7:
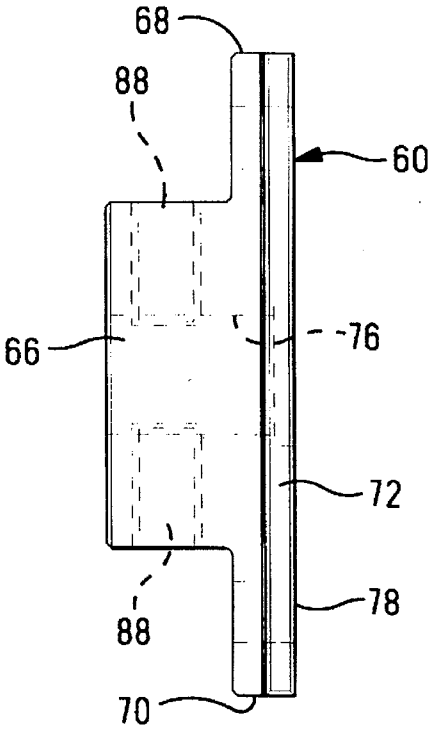
Figure 6:
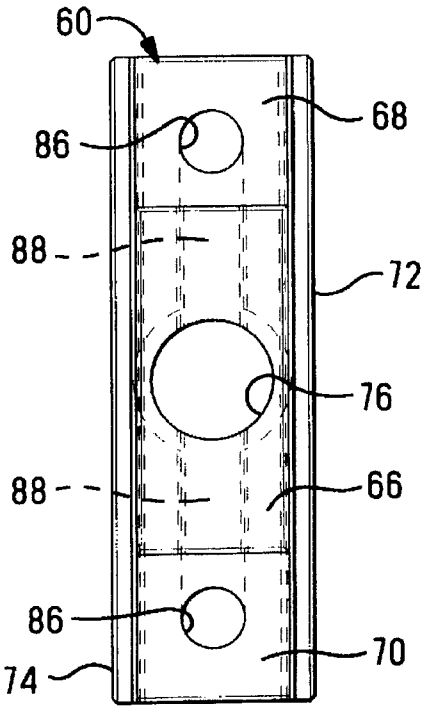
Figure 9:
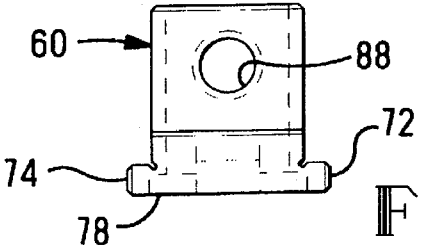

As shown in FIGS. 4 and 5, the crimping tooling 50 consists of a crimper 52, and anvil 54, two opposed but identical terminal supports 56 and 58, and a self centering body 60 carrying a cylindrically shaped terminal holder 62. The crimper 52 is secured to the fixed plate 40 while the anvil. 54 is secured to and carried by the ram 38, both being secured by any suitable means, such as screw fasteners 64. As best seen in FIGS. 6 through 9, the self centering body 60 includes a central block 66 having portions 68 and 70 extending outwardly in opposite directions. A pair of flanges 72 and 74 extend from opposite sides of the body 60 and run for its entire length, including the central block and the extending portions. A bore 76 extends through the body 60, intersecting a major surface 78 and being perpendicular thereto, as best seen in FIGS. 6 and 7. The bore 76 includes a relatively shallow counterbore 80 formed in the major surface 78. An elongated opening 82, or slot, is formed in the surface 78 and has a longitudinal axis 84, as shown in FIG. 8. A clearance hole 86 is formed through each extended portion 68 and 70 at opposite ends of the elongated opening 82, for a purpose that will be explained below. The central block 66 includes two opposed threaded holes 88 that intersect the bore 76, as best seen in FIGS. 6, 7, and 9. The bore 76 is a slip fit with the outer diameter of the terminal holder 62 which includes a central bore 90 sized to closely receive a terminal 92 and a clearance counterbore 94, where appropriate, depending on the specific terminal being crimped. As shown in FIG. 5, the terminal holder is held in position within the bore 90 by means of two spring loaded ball plungers 96 that are threaded into the holes 88 in the self centering body 60. The ball plungers engage an annular groove 98 that is formed in the outer diameter of the terminal holder 62, thereby serving as a detent. The ball plungers are arranged so that the terminal holder can easily be removed simply by pulling it out along its axis and then replacing it with a terminal holder of a different size as desired.

Figure 12:
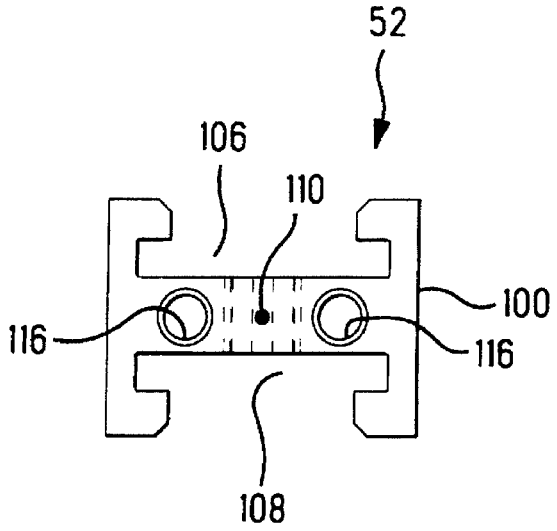
FIGS. 10, 11, and 12 are front, side, and end views, respectively, of the crimper shown in FIG. 5.
Figure 10:
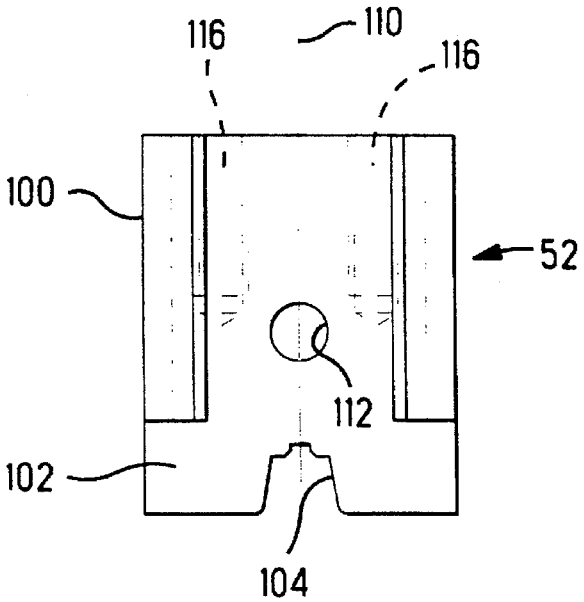
Figure 11:
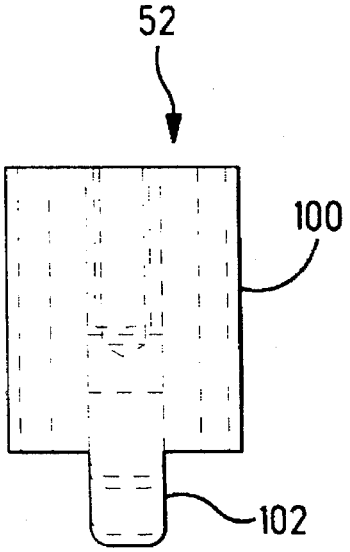

As shown in FIGS. 10, 11, and 12, the crimper 52 includes a shank 100 and a crimping member 102 having a contoured surface 104 for crimping the terminal 92 in cooperation with the anvil 54. A pair of back to back T-shaped openings 106 and 108 are formed in the shank 100, as best seen in FIG. 12, centrally about an axis 110 that extends through the center of the contoured surface 104, as shown in FIG. 10. The surfaces of the T-shaped openings are parallel to the axis 110 and spaced so that the opening 106 will slidingly receive the flanges 72 and 74 of the self centering body 60 and the other opening 108 will slidingly receive the terminal support 56, with a very small amount of lateral play in both cases. A hole 112 is formed through the shank 100 intersecting the axis 110 and perpendicular thereto, as best seen in FIG. 10. The hole 112 is a light press fit for a pin 114 that extends through the hole and into the two T-shaped openings 106 and 108, as shown in FIG. 5. A pair of threaded holes 116 are formed in the shank 100 on opposite sides of the axis 110 and parallel thereto, as shown in FIGS. 10 and 12. The holes 116 receive the screws 64 for securing the crimper 52 to the fixed plate 40.

Figure 13:
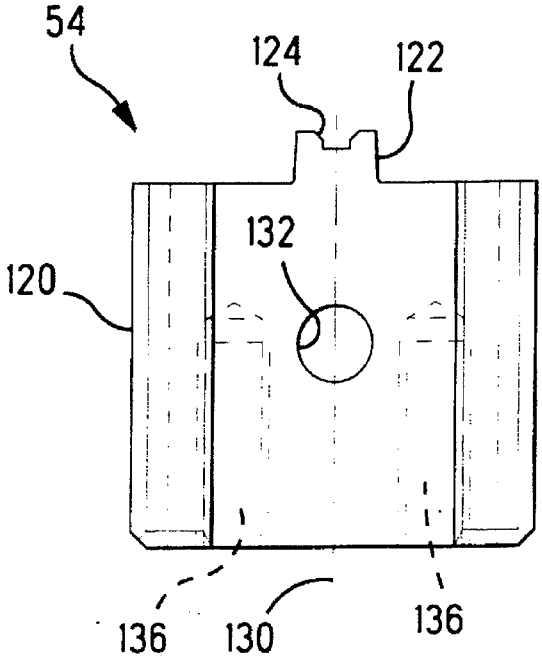
FIGS. 13, 14, and 15 are front, side, and end views, respectively, of the anvil shown in FIG. 5.
Figure 14:
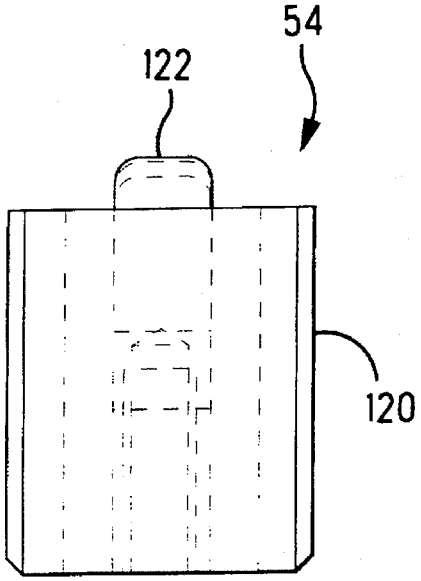
Figure 15:
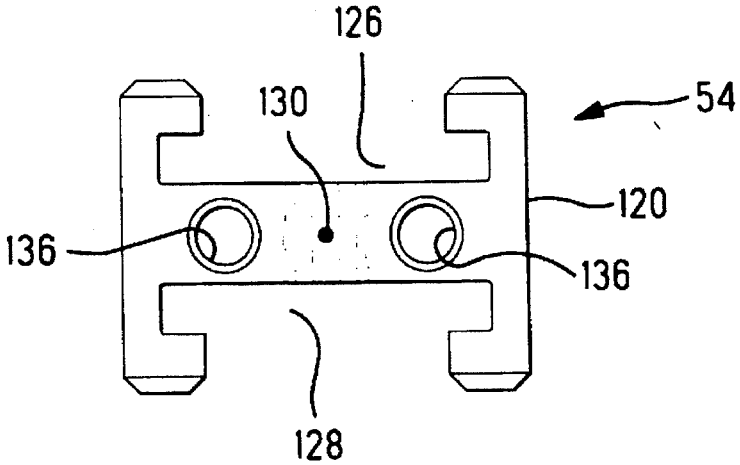

As shown in FIGS. 13, 14, and 15, the anvil includes a shank 120 and a crimping member 122 having a contoured surface 124 for crimping the terminal 92 in cooperation with the crimper 52. Note that the mating contoured surfaces 104 and 124 may be any surfaces suitable for achieving the desired crimp profile. An example of suitable contoured crimping surfaces is disclosed in U.S. Pat. No. 4,828,516 which issued May 9, 1989 to Shaffer. A pair of back to back T-shaped openings 126 and 128 are formed in the shank 120, as best seen in FIG. 15, centrally about an axis 130 that extends through the center of the contoured surface 124, as shown in FIG. 13. The surfaces of the T-shaped openings are parallel to the axis 130 and spaced so that the opening 126 will slidingly receive the flanges 72 and 74 of the self centering body 60 and the other opening 128 will slidingly receive the terminal support 58, with a very small amount of lateral play in both cases. A hole 132 is formed through the shank 120 intersecting the axis 130 and perpendicular thereto, as best seen in FIG. 13. The hole 132 is a light press fit for a pin 134 that extends through the hole and into the two T-shaped openings 126 and 128, as shown in FIG. 5. A pair of threaded holes 136 are formed in the shank 120 on opposite sides of the axis 130 and parallel thereto, as shown in FIGS. 13 and 15. The holes 136 receive the screws 64 for securing the anvil 54 to the ram 38. The crimping member 122 is sized to closely mate with the crimping member 102 in the usual manner so that their respective contoured surfaces 124 and 104 will cooperate to crimp the terminal 92.

Figure 20:
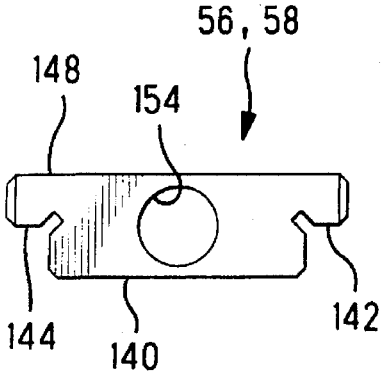
FIGS. 16, 17, 18, 19, and 20 are front, side, rear, bottom end, and top end views, respectively, of the terminal support shown in FIG. 5.
Figure 16:
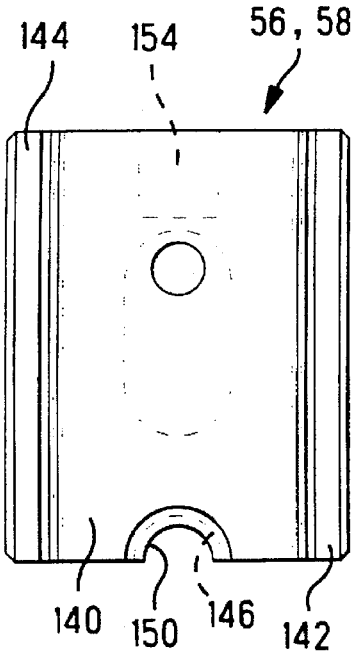
Figure 17:
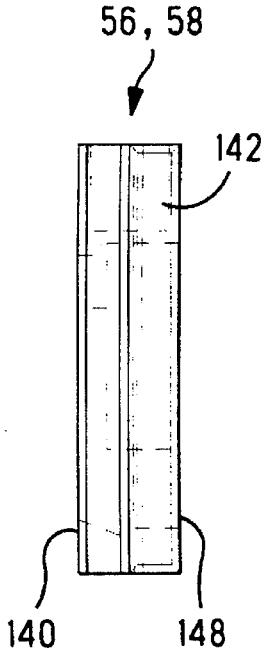
Figure 18:
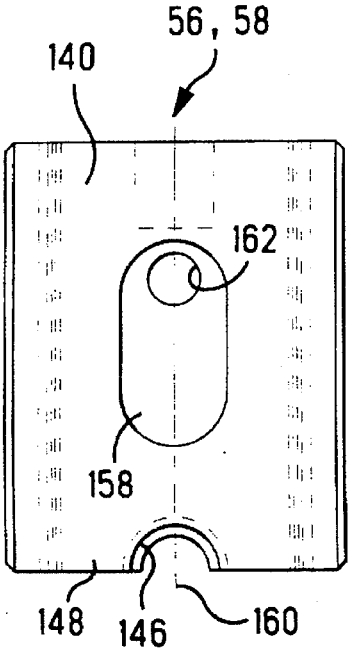
Figure 19:
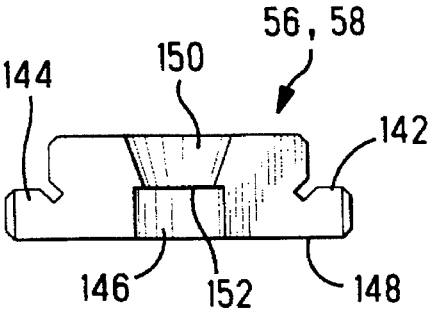

Since the two terminal supports 56 and 58 are identical, only the terminal support 56 will be described here. As shown in FIGS. 16 through 20, the terminal support 56 is of rectangular cross section having a main portion 140 and two flanges 142 and 144 that extend outwardly from opposite sides of the main portion. The flanges 142 and 144 are sized to be a sliding fit with the two T-shaped openings 108 and 128 with little or no lateral play. A semicircular opening 146 having a radius substantially equal to the radius of the barrel end of the terminal 92 is formed in an end of the main portion 140, as best seen in FIGS. 18 and 19. The axis of the semicircular opening 146 is perpendicular to a major surface 148 of the terminal support 56. A semicircular chamfer 150 is formed coaxial to the opening 146 and tapers inwardly to a necked-down region 152 that is smaller than the opening 146. This tapered chamfer serves as a wire guide, as will be explained below. A blind bore 154 is formed in an end of the terminal support 56 that is opposite the end containing the opening 146,, as shown in FIGS. 15 and 20, and is sized to loosely receive a compression spring 156, as shown in FIG. 5, for a purpose that will be explained. An elongated recess 158 is formed in the major surface 148 having a longitudinal axis 160 that extends through the center of the terminal support 56 and the opening 146. The width of the recess 158 is slightly larger than the diameter of the pins 114 and 134. An access hole 162 is formed through the floor of the recess 158 near the end furthest from the opening 146, and completely through the main portion 140.

The parts of the crimping mechanism 50 are assembled by sliding the two extended portions 68 and 70 of the self centering body 60 into the two T-shaped openings 106 and 126 of the crimper 52 and anvil 54, respectively. The two terminal, supports 56 and 58 are then assembled to the subassembly so that their flanges 142 and 144 slidingly engage respective T-shaped openings 108 and 128 of the crimper 52 and anvil 54, and their openings 146 are mutually opposing. The two pins 114 and 134 are then inserted through the clearance holes 86 in the self centering body 60 and into the light press fit holes 112 and 132, respectively, of the crimper and anvil. The pin 114 extends into both the elongated opening 82 in the self centering body 60 and the recess 158 of the terminal support 56. The pin 132 extends into both the elongated opening 82 and the recess 158 in the terminal support 58. These two pins thereby hold the five parts captive as an assembly. Access to the pins is easily obtained by means of the access holes 162 if it is desired to remove the pins. The two compression springs 156 are inserted into the holes 154 of the two terminal supports 56 and 58 just prior to assembling the crimping mechanism 50 to the hand tool 30 by means of the screws 64, as set forth above.

Figure 22:
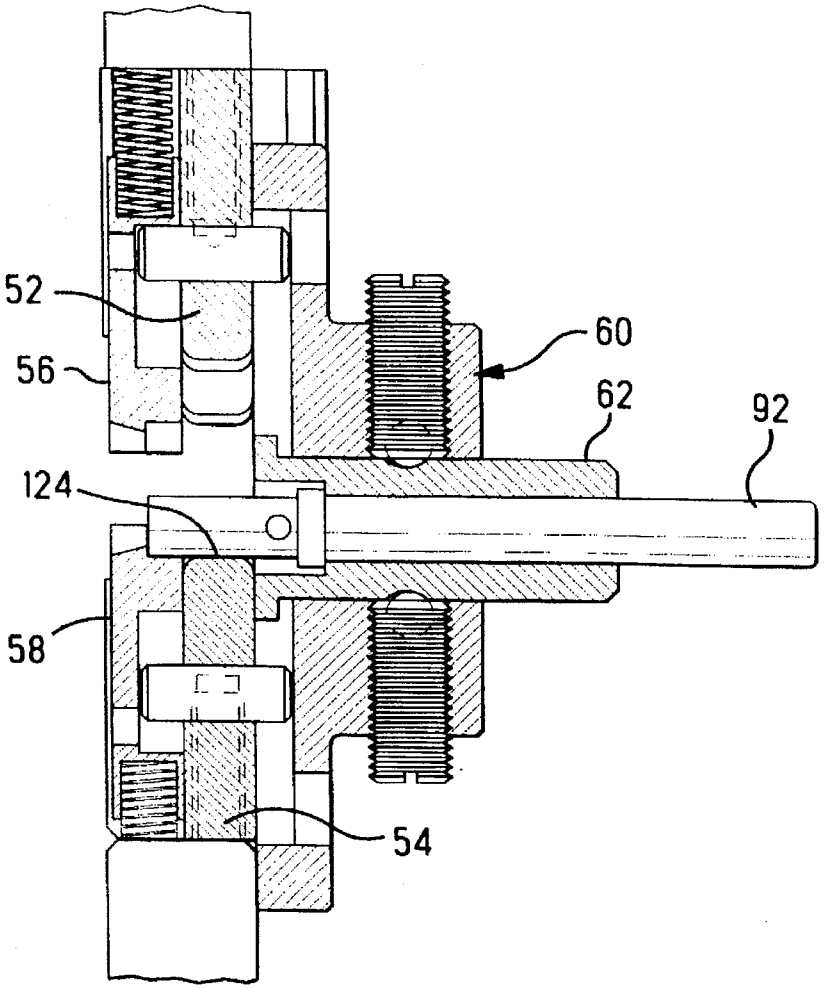
FIGS. 21 through 24 are views similar to that of FIG. 5 showing the crimping mechanism in various operating positions.
Figure 21:
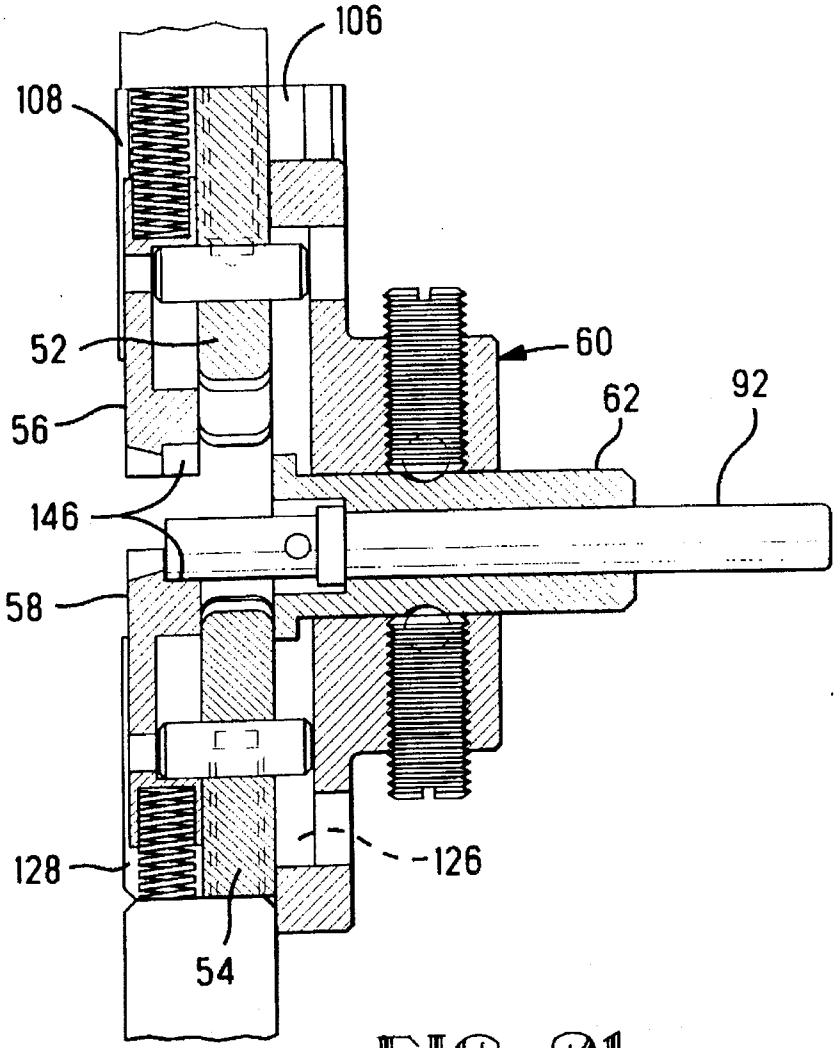
Figure 24:
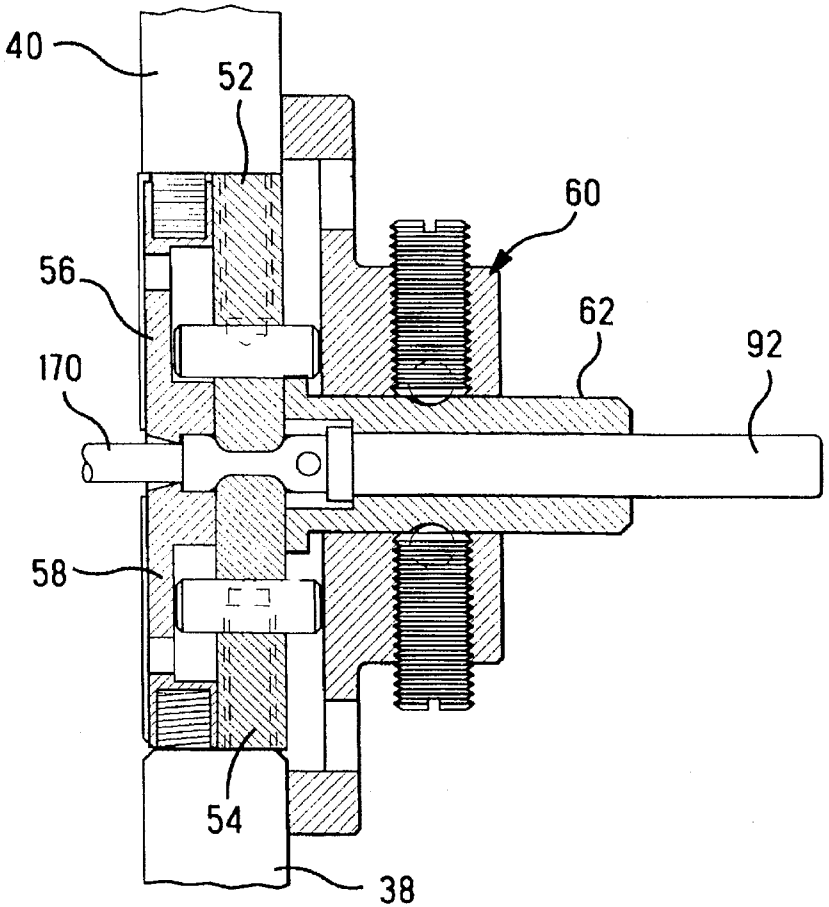
Figure 23:
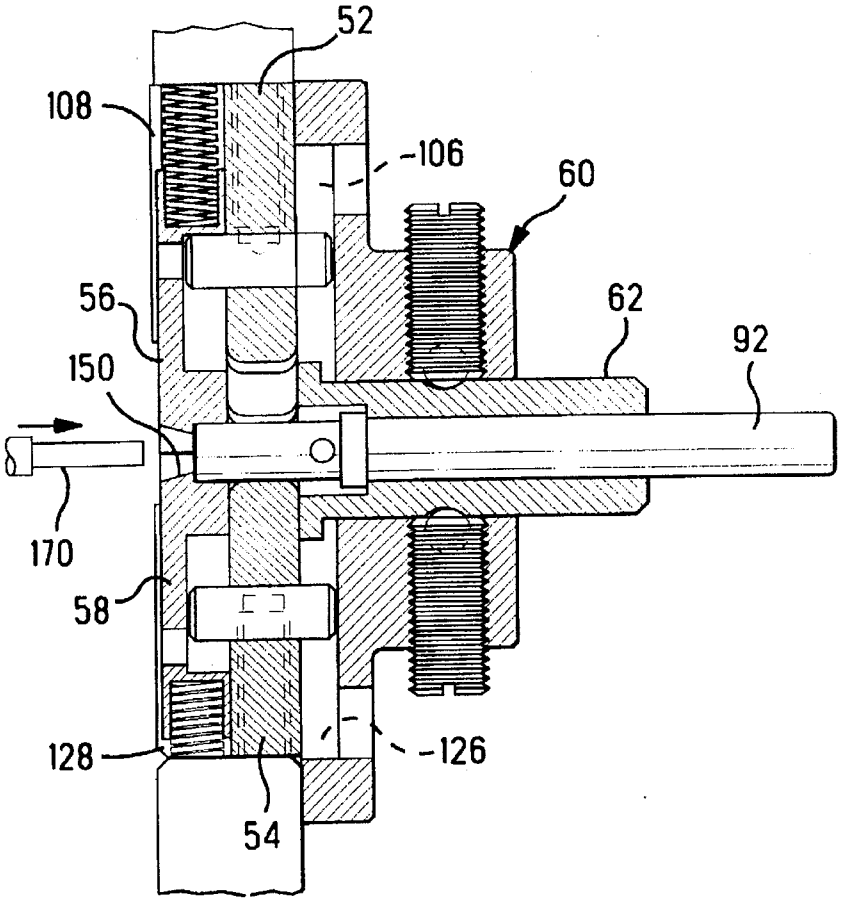

In operation, as shown in FIGS. 5 and 21 through 24, a terminal to be crimped is inserted into position in the bore 90 of the terminal holder 62, as shown in FIG. 5. The actuating lever 36 is then operated to start the ram 38 moving in the first direction toward the fixed plate 40. As the ram moves, the anvil 54 and terminal support 58 are moved upwardly as the extended portion 70 slides in the T-shaped opening 126 of the anvil, and the opening 146 of the terminal support 58 comes into engagement with the underside edge of the terminal 92, as shown in FIG. 21. As movement of the ram continues, the contoured surface 124 of the anvil 54 engages the underside of the barrel of the terminal 92, as shown in FIG. 22, and begins to move it upwardly along with the self centering body 60, which slides in the T-shaped opening 106 of the crimper 52. This movement continues until the upper edge of the terminal barrel engages the opening 146 of the terminal support 56, as shown in FIG. 23. At this point the operator momentarily discontinues operation of the lever 36 and inserts a conductor 170 through the wire guide 150 and into seated engagement with the barrel of the terminal 92. After the conductor is fully seated in the barrel, the lever 36 is again actuated to begin moving the ram again in the first direction toward the fixed plate 40. This movement continues until the anvil 54 and crimper 52 matingly engage, as shown in FIG. 24, and cooperate to crimp the barrel of the terminal 92 between the contoured surfaces 124 and 104. The lever 36 is then released and the ram 38 moved in the second direction away from the fixed plate 40 to the starting position shown in FIG. 5. As the ram 38 is retracted, the pins 114 and 134 engage the ends of the recesses 158 of the two terminal supports 56 and 58 thereby retracting them away from the crimped terminal along wit the crimper 52 and anvil 54. In the event that the crimped terminal sticks in the crimper during retraction of the ram, the pin 134 will be first to engage the end of the elongated opening 82 in the body 60, thereby pulling the body along with the retracting ram and automatically stripping the crimped terminal out of the crimper 32. This relieves the operator of the burden of pulling or prying the crimped contact out of the crimper and potentially damaging the contact or the connection. The crimped terminal and conductor are then removed to complete the cycle.

The two T-shaped openings 106 and 126 serve to permit free movement of the self centering body 60 in the first and second directions. This movement is effected by the anvil 54 contacting the barrel of the terminal 92 and urging it, and the self centering body 60, toward the crimper 52 until the terminal is precisely centered between the two contoured crimping surfaces 104 and 124. It will be understood that this same self centering action will occur in the case where the anvil is secured to the fixed plate 40 and the crimper is secured to the ram 38.

While a manually powered hand tool 30, having a fixed plate and a reciprocating ram, is described herein to illustrate the teachings of the present invention, other types of hand tools, both manually operated and powered, as well as applicators that are operated in a press may be utilized. In hand tools or applicators having a fixed plate and a single ram, either the crimper or the anvil may be secured to and carried by the ram. However, hand tools and applicators having two opposing reciprocating rams or surfaces may also be advantageously utilized with the crimping mechanism of the present invention.

An important advantage of the present invention is that the terminal being crimped is self centered between the crimper and the anvil simply by virtue of the self centering body that holds the terminal. This provides the required accuracy for precision crimps while reducing the cost to manufacture the tool. Additionally, the terminal supports hold the end of the terminal barrel during the crimping process so that it remains centered with respect to the axis of the terminal and retains the circular shape of the end. Another important advantage is that the crimped terminal is automatically stripped out of the crimper upon release of the lever and retraction of the ram. This eliminates the need for the operator to pull or pry a stuck terminal out of the tool. This crimping mechanism lends itself to use with hand tools and actuators having simple linear actuating mechanisms. Additionally, when a terminal of different size must be crimped, the terminal holder can easily be removed simply by pulling it out along its axis and then replacing it with the desired size terminal holder.

I claim:

1. A tool for crimping a terminal onto a conductor, said terminal having an axis, comprising:

(a) an actuator mechanism having first and second mutually opposed members, one of which is arranged to move in a first direction toward the other and in a second direction opposite thereto;

(b) a crimper coupled to and carried by said first member and an anvil coupled to and carried by said second member, said crimper and anvil arranged to matingly engage when said first and second members are moved in said first direction thereby crimping said terminal onto said conductor;

(c) a body movably coupled to both said crimper and said anvil, said body having an opening for receiving said terminal and holding it so that said axis is perpendicular to said first direction during said movement of said first and second members in said first direction, the body being free to move in the first direction and in the second direction so that said terminal is automatically self centered between said crimper and said anvil when engaged thereby.

2. The tool according to claim 1 wherein said crimper and said anvil each include contoured surfaces for engaging and crimping said terminal, wherein said body holds said terminal so that said axis is substantially parallel to at least one of said contoured surfaces.

3. The tool according to claims 2 wherein said coupling of said body to said crimper and to said anvil is effected by means of a portion of said body being in sliding engagement with an opening in each of said crimper and said anvil.

4. The tool according to claim 3 wherein said crimper has a first shank attached thereto and said anvil has a second shank attached thereto, and wherein said portion of said body is a pair of spaced flanges on opposite sides of said body extending outwardly, and said openings in said crimper and said anvil are T-shaped first and second openings formed in each of said first and second shanks, respectively, that slidingly receive said spaced flanges.

5. The tool according to claim 4 wherein said body includes an elongated opening formed in a surface and having a longitudinal axis that is substantially parallel to said first and second directions of movement, and wherein said crimper includes a first projection extending into said elongated opening and said anvil includes a second projection extending into said elongated opening, said first and second projections in abutting alignment with the ends of said elongated opening for limiting movement in said second direction of said crimper and said anvil with respect to said body so that said sliding engagement is maintained.

6. The tool according to claim 5 including a cylindrically shaped terminal holder having a bore for receiving said terminal and a concentric outer diameter in engagement with said opening in said body for receiving said terminal, wherein said terminal holder is removably secured within said opening in said body.

7. The tool according to claim 6 wherein said removably securing of said terminal holder is effected by means of a detent projecting into said opening in said body and biased into engaging a depression in said outer diameter of said terminal holder.

8. The tool according to claim 7 wherein said detent is a spring loaded ball detent.

9. The tool according to claim 4 including first and second supports having opposed mating surfaces each of which has a portion of a seat that engages and supports an end of said terminal during said crimping thereof.

10. The tool according to claim 9 wherein said first support is slidingly coupled to said first shank and said second support is slidingly coupled to said second shank, wherein said first and second shanks have third and fourth T-shaped openings formed therein opposite said first and second T-shaped openings, respectively, and wherein each of said first and second supports includes a pair of spaced flanges on opposite sides thereof extending outwardly into sliding engagement with a respective one of said third and fourth T-shaped openings, said first and second supports arranged to undergo movement parallel to said first and second directions.

11. The tool according to claim 10 wherein each of said first and second supports is resiliently biased in a direction toward said axis of said terminal.

12. The tool according to claim 11 wherein said first and second supports are resiliently biased by means of a compression spring between said first support and said first member and a compression spring between said second support and said second member.

13. The tool according to claim 12 wherein said first and second supports are arranged so that when said first and second members are moved in said first direction, said seats of said first and second supports engage and support opposite sides of said terminal prior to engagement of said terminal by said crimper and said anvil.

14. The tool according to claim 13 wherein said first and second support members are further arranged so that after said seats engage and support said sides of said terminal, said first and second members continue to move in said first direction, without further movement of said first and second supports, until said crimper and said anvil engage and crimp said terminal onto said conductor.

15. The tool according to claim 14 wherein said body includes an elongated opening formed therein and having a longitudinal axis that is substantially parallel to said first and second directions of movement, and each of said first and second supports includes an elongated opening therein, and wherein said crimper includes a first pin extending therefrom and into said elongated openings in both said body and said first support and said anvil includes a second pin extending therefrom and into said elongated openings in both said body and said second support, said first and second pins in abutting alignment with respective ends of said elongated openings for limiting movement in said second direction of said crimper and said anvil with respect to said body and for limiting movement in said second direction of said first and second supports with respect to said crimper and said anvil, respectively, so that said sliding engagement of said first and second supports and said body with respect to said crimper and said anvil is maintained.

16. The tool according to claim 15 wherein said first and second supports include chamfered surfaces adjacent said seats for guiding said conductor during insertion into said terminal.

17. The tool according to claim 1 wherein said lateral movement of said body is mostly limited to movement that is substantially parallel to said first and second directions.

18. The tool according to claim 1 including first and second supports having opposed mating surfaces each of which has a portion of a seat that engages and supports an end of said terminal during said crimping thereof.

19. The tool according to claim 18 wherein said crimper has a first shank attached thereto and said anvil has a second shank attached thereto, and wherein said body includes a pair of spaced flanges on opposite sides thereof extending outwardly, and a pair of back to back first and third T-shaped openings formed in said first shank and a pair of back to back second and fourth T-shaped openings formed in said second shank, said spaced flanges of said body slidingly received in said first and second T-shaped openings, said first support being sliding received in said third T-shaped opening and said second support being slidingly received in said fourth T-shaped opening.

* * * * *